United States Patent [19]

Genese

[11] 4,203,443

[45] May 20, 1980

[54] ADDITIVE TRANSFER UNIT WITH INTERLOCKING MEANS

[75] Inventor: Joseph N. Genese, Waukegan, Ill.

[73] Assignee: Abbott Laboratories, Chicago, Ill.

[21] Appl. No.: 858,495

[22] Filed: Dec. 8, 1977

[51] Int. Cl.[2] ..... A61J 1/00

[52] U.S. Cl. ..... 128/272.3; 222/83; 141/329

[58] Field of Search ..... 206/222 (U.S. only); 128/272.1, 272.3, 218 M, 216, DIG. 5, 221; 141/329, 330; 222/81, 83

[56] References Cited

U.S. PATENT DOCUMENTS

| | | | |
|---|---|---|---|
| 2,724,383 | 11/1955 | Lockhart | 128/272.1 |
| 3,033,202 | 5/1962 | Richter et al. | 128/272 |
| 3,392,726 | 7/1968 | Pochyla et al. | 128/272.1 |
| 3,788,369 | 1/1974 | Killinger | 128/272 |
| 3,826,260 | 7/1974 | Killinger | 128/272 |
| 3,828,779 | 8/1974 | Ogle | 128/272 |
| 3,890,972 | 6/1975 | Standley et al. | 128/220 |
| 3,938,520 | 2/1976 | Scislowicz | 128/272.3 |
| 3,987,791 | 10/1976 | Chittenden | 128/272.3 |
| 3,999,543 | 12/1976 | Lacey | 141/329 |
| 4,059,112 | 11/1977 | Tischlinger | 141/329 |

*Primary Examiner*—Robert W. Michell
*Assistant Examiner*—J. L. Kruter
*Attorney, Agent, or Firm*—Robert L. Niblack; Neil E. Hamilton

[57] ABSTRACT

An additive transfer device for storing and transferring of a medicament to a solution container such as an I.V. bag having an exposed port. The transfer device is accommodated in the neck of an additive container having a pierceable sealing element. A piercing guide member has a projecting tubular portion which extends into the tubular neck and affords a guide passageway for a piercing member with interlocking means being disposed in conjunction with the piercing guide member and the piercing member whereupon after their interlocking, the sealing element in the neck of the additive container is pierced. Wall means are provided from either the piercing guide member or the piercing member and fits over the tubular port of the I.V. bag. In the preferred embodiment, a needle guard member is utilized to actuate the interlocking means and afford the piercing of the pierceable sealing element. When the opposing pointed end of the piercing element is pierced through the I.V. port, communication can be made between the additive container and the I.V. bag.

4 Claims, 8 Drawing Figures

ADDITIVE TRANSFER UNIT WITH INTERLOCKING MEANS

BACKGROUND OF THE INVENTION

This invention relates to a device for storing and transferring a medicament to a flexible container such as an I.V. bag. More particularly, the invention relates to an additive transfer device wherein an interlocking means is utilized in conjunction with a piercing guide member and a piercing member to afford a piercing through the sealing element in the additive container and in particular to a needle guard member which can be utilized to actuate the interlocking means.

Additive transfer units of the type concerned with in this invention are described in U.S. Pat. Nos. 3,033,202; 3,788,369; 3,826,260; 3,828,779; 3,938,520 as well as 3,987,791. Many of the units described in these patents, for example in U.S. Pat. Nos. 3,033,202; 3,938,520 and 3,987,791, are not specifically directed to a device for making an addition to a flexible I.V. bag. In the instance of U.S. Pat. Nos. 3,788,369 and 3,828,779 which are so directed, a specially designed closure for a vial or a large, multicomponent device is indicated as well as in U.S. Pat. No. 3,826,260. The prior art nowhere provides a simplified and compact transfer unit for making additions to an I.V. flexible container. In particular, the prior art does not provide an additive device for use with an I.V. bag wherein a single motion either by means of a needle guard acting on an interlocking means or a wall cover for the I.V. bag port can be employed to effect movement of a simplified interlocking means to cause the piercing member to pierce through a seal in the neck of a container and afford communication between the small volume container and the I.V. bag. The opposing end of the piercing cannula is then inserted through the bag port and the contents of the container expelled with a simple motion.

It is an advantage of the present invention to afford a novel additive transfer device which is specifically adapted for use with a flexible container. Other advantages are an additive transfer unit which can be employed with a small volume, collapsible or pressurized container; utilizes a minimum number of parts and a minimum number of interfitting components; can be activated in a fast manner while having one of the components serve multiple functions.

SUMMARY OF THE INVENTION

The foregoing advantages are accomplished and the shortcomings of the prior art are overcome by the present additive transfer unit which is employed with either an additive container having a flexible wall or a rigid one. A pierceable sealing element is positioned in sealing engagement with a flow path in the tubular neck of the additive container. A piercing guide member having a projecting tubular portion extends into the neck of the container and affords a guide passageway extending through the guide member. A piercing member having a channel therethrough for the flow of the medicament in the additive container has piercing points on both ends with a portion of the piercing member in slidable contact with the guide passageway. Interlocking means are associated with the piercing guide member and the piercing member. Wall means which afford a guide for locating the piercing member on the port of an I.V. bag extend from either the piercing guide member or the piercing member in a direction opposite to the projecting tubular portion and is coextensive with a portion of the piercing member except for an end portion. In a preferred manner, the interlocking means is afforded by expandable finger elements and a compartment member, with an annular projection receivable past the finger elements and into the compartment. The interlocking means is actuated along with a piercing of the sealing element in the additive container neck by means of a needle guard member or the wall guide means. In the instance of the needle guard member, it is slidably received over the piercing member and surrounds the piercing point intended to be inserted through the port on the flexible bag and the wall guide means is affixed directly to the piercing member.

BRIEF DESCRIPTION OF DRAWING

A better understanding of the additive transfer unit of this invention will be afforded by reference to the drawing wherein.

DESCRIPTION OF THE EMBODIMENT

Figure 1:
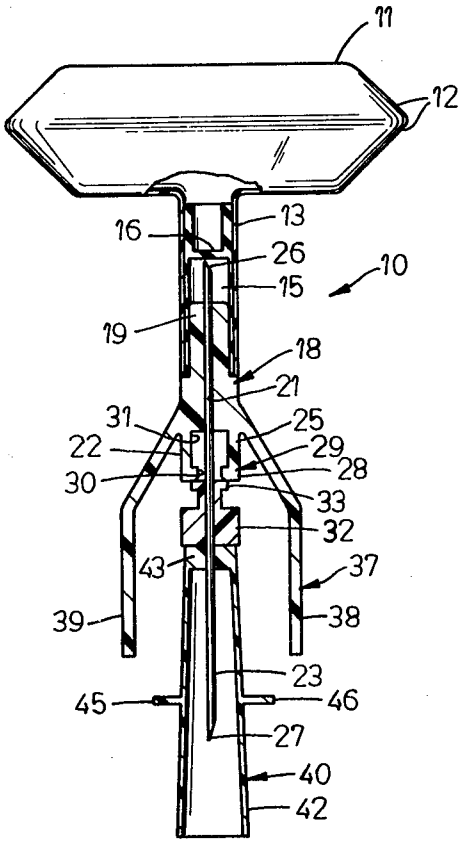
FIG. 1 is a view in side elevation of the transfer unit of this invention with portions shown in section.
Figure 2:
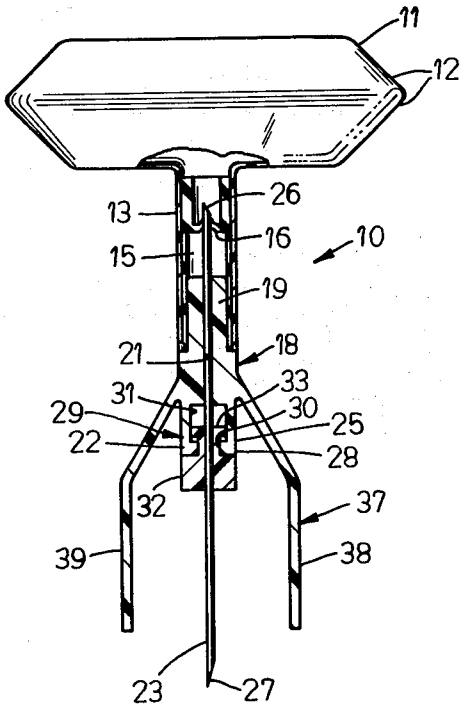
FIG. 2 is a view similar to FIG. 1 except with the needle guard member removed and the cannula communicating with the additive container.
Figure 3:
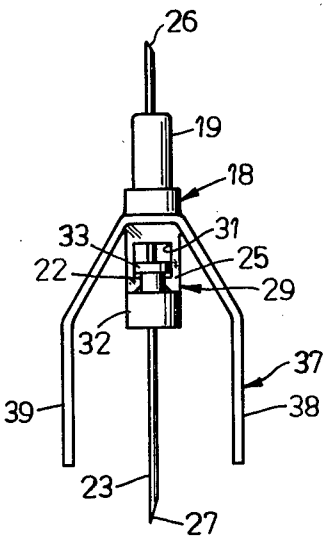
FIG. 3 is a view in side elevation showing the piercing guide member separated from the additive container.

Proceeding to a detailed description of one embodiment of the invention, the additive transfer device 10, as best shown in FIGS. 1, 2 and 3, is shown operatively associated with an additive container 11. A tubular neck portion 13 extends from additive container 11 and provides a passageway 15 with a pierceable sealing element 16. A piercing guide member generally 18 having a projecting tubular portion 19 is seated in tubular neck 13. A hollow guide passageway 21 is centrally positioned in piercing guide member 18 to provide a slidable path for piercing member 23. Piercing member 23 has oppositely disposed piercing points 26 and 27 with the usual hollow channel interconnecting the two points. It will be noted that piercing guide member 18 has two flexible, extending finger portions 22 and 25 with flanges such as 28. Finger portions 22 and 25 are laterally expandable and afford an interlocking means 29 with annular projection 33 extending from annular block 32. An orifice 30 is afforded between flanges 28 of finger portions 22 and 25 and an annular compartment 31 is provided inwardly of orifice 30. Wall means 37 extend from the piercing guide member 18 and are in the form of two arm members 38 and 39 extending substantially parallel with piercing cannula 23. Slidably received over piercing cannula member 23 is a needle guard 40 which has base portion 43 for slidably receiving the piercing cannula and contacting block 32. Extending from the base portion is a cylindrical body portion 42 from which extend oppositely disposed finger grips 45 and 46.

Figure 4:
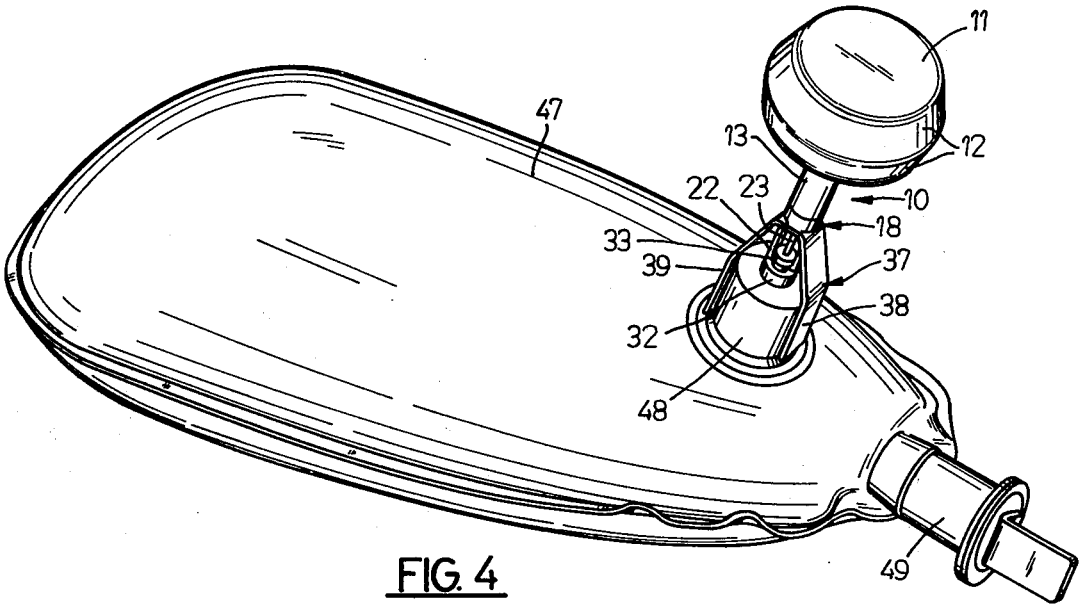
FIG. 4 is a perspective view showing the additive container unit of this invention operatively engaging the additive port of a flexible container.

Referring to FIG. 4, the additive transfer unit 10 is shown operatively engaging an additive port 48 of a flexible I.V. bag which also has an administration port 49. The I.V. bag 47 is of the type described in U.S. Pat. No. 3,915,212 entitled "Flexible Medicinal Fluid Container Having a Combined Fill Administration Port and Reinforced Hanger" and is commonly assigned.

DESCRIPTION OF OTHER EMBODIMENTS

In the following FIGS. 5-8, other embodiments of the previously described additive administration apparatus 10 are described. Similar parts will be referred to with similar numbers except that they will be in the "100", "200", "300", and "400" series.

Figure 5:
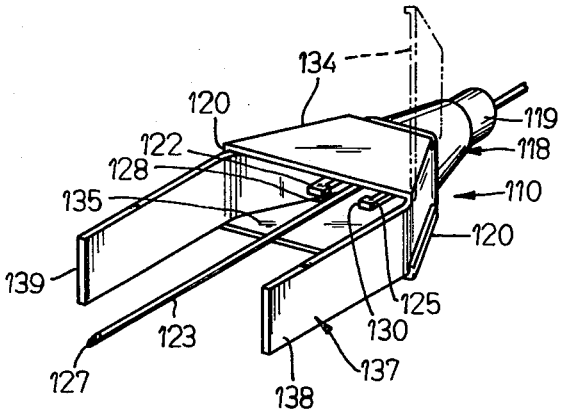
FIG. 5 is a view in perspective showing an alternative embodiment of the invention.

In the embodiment shown in FIG. 5, the additive transfer device 110 is substantially the same as that shown for unit 10 except that it has additional hinged side walls 134 and 135 which fit laterally across the wall means 137 in an angular fashion. This provides a bracing by means of the snap fitment afforded by flanges such as 120 engaging the angular portions of arm members 138 and 139. It will be further noted in this embodiment that the portion of the interlocking means for piercing member 123 such as the annular block 32 and the annular projection 33 are not shown but would be utilized in this embodiment in conjunction with finger portions 122 and 125.

Figure 6:
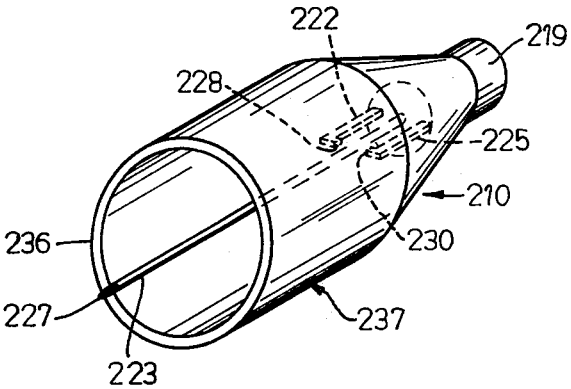
FIG. 6 is a view similar to FIG. 5 showing yet another embodiment.

In embodiment 210 shown in FIG. 6, the basic difference between this unit and that shown in the previous ones is in the utilization of a different form of wall means 237. A cylindrical wall member 236 is utilized in place of the previously described separate arm members such as 138 and 139. Again, the previously referred to interconnecting means such as would be afforded between the annular projection 33 on piercing member 223 for engagement with finger portions 222 and 225 is not shown.

In embodiment 310, the major difference between this embodiment and that shown in FIG. 1, is in the provision of a different type of additive container 311 having a multiplicity of pleated side walls 312 rather than one double pleat 12 for additive container 11.

Figure 8:
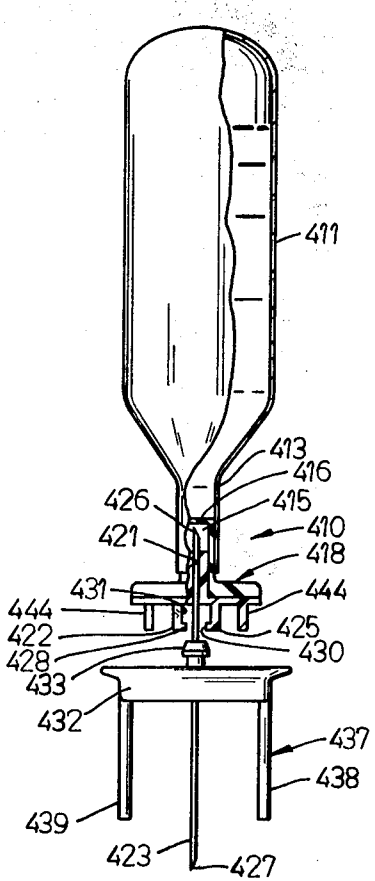
FIG. 8 is a view in side elevation with portions broken away showing a still further embodiment.
Figure 7:
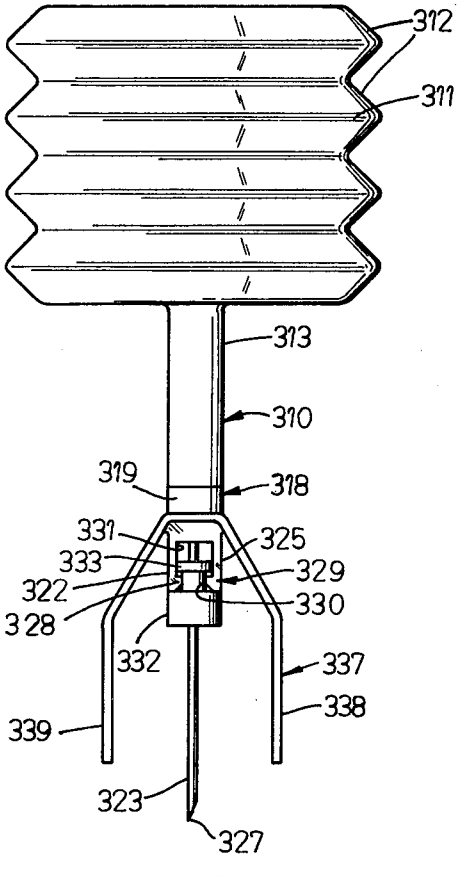
FIG. 7 is a view in side elevation showing an embodiment similar to that of FIG. 1 except with a different additive container.

Additive transfer unit 410, as shown in FIG. 8, is different from the preceding embodiments in that the wall means 437 is afforded by arm members 438 and 439 being attached to base or annular block 432 which is directly secured to the piercing cannula 423. Extending from the base portion 432 and secured to cannula 423 is annular projection 433 for sliding past laterally expendable finger portions 422 and 425 and into compartment 431. Additionally, stop members 444 extend from the piercing guide member generally 418 for ultimate contact with annular block 432. It will be further noted in this embodiment 410 that another type of additive container 411 is shown. In this instance, container 411 will have a rigid wall construction so that it can be pressurized.

OPERATION

A better understanding of the advantages of the additive administration apparatus 10 as well as those described in other embodiments will be had by description of their operation. As all the units operate on basically the same principle, only the embodiment referred to as unit 10 will be described with specific comments made for the other embodiments in any manner in which they differ in their operation.

The additive transfer device 10 will be packaged in a sterile condition and be assembled as indicated in FIG. 1 with piercing guide member 18 positioned in tubular neck 13 of container 11 and piercing point 26 spaced from pierceable sealing element 16. When it is desired to utilize the additive transfer device, a force will be exerted on the needle guard 40, such as by grasping the finger grip members 45 and 46, to move annular contact block 32 in the direction of additive container 11. This force will cause annular projection 33 to pass through orifice 30 by lateral displacement of fingers 22 and 25, and enter annular compartment 31. Simultaneously, a portion of piercing member 23 will be guided in guide passageway 21 and piercing point 26 will have pierced through pierceable sealing element 16 to thereby provide fluid communication with the contents of additive container 11. The transfer device 10 will then appear as in FIG. 2. Needle guard 40 will then be slidably removed from piercing member 23 and in this condition, the additive transfer device 10 will be ready for insertion through an additive port 48 on flexible I.V. bag 47. To accomplish this, the arm members 38 and 39 will be orientated around the outside of additive port 48 and moved downwardly thereover until the ends of the arms contact the outside surface of bag 47. As arm members 38 and 39 are so positioned, piercing point 27 will have pierced through the seal in the additive port 48 to effect fluid communication with the inside of bag 47. In this position, fluid communication will be provided between the inside of I.V. bag 47 and the inside of additive container 11. All that is then required to expel the contents of the additive container 11 into bag 47 is to compress the side walls such as 12 of container 11 in the normal manner for a pleated collapsible container. This will force the contents of the container 11 into bag 47. With the removal of the additive container from the bag, the contents of bag 47 is then ready for normal administration by means of the usual I.V. administration apparatus.

Units 110, 210 and 310 will operate substantially in the same manner as previously described for unit 10. In the instance of unit 110, there is an added advantage in having side walls 134 and 135 for frictional engagement across arm members 138 and 139 so as to stabilize them from further expansion when the additive transfer unit is placed over the additive port such as 48. Concerning unit 210, this device offers a convenient manner of placing the unit over a rounded additive port by providing a continuous cylindrical wall 236 in place of two separate arms such as 138 and 139. Unit 310 will also operate in substantially the same manner as unit 10 except that in place of an additive container 11 with only two side walls, a multiplicity of accordian pleated side walls such as 312 will be compressed to expel the contents of the additive container 311 into bag 47.

Unit 410 is different from those previously described in that the wall means 437 is directly secured to the piercing member 423 and can thereby serve as the means to move the piercing member 423 with point 426 through pierceable sealing element 416 to provide communication with the contents of additive container 411. As previously indicated, this is accomplished when annular projection 433 moves through orifice 430 and into compartment 431, the annular projection being retained in the compartment by means of flanges 428 on finger portions 425 and 422 to thereby retain the annular block 432 in frictional engagement with piercing guide member 418. As the contents of container 411 are pressurized arm members 438 and 439 should be positioned around the additive container port on I.V. bag 47 prior to piercing of sealing element 416, so that the bag additive port 48 and the sealing element 416 are pierced simultaneously or the bag port 48 is pierced first by piercing member 423.

The foregoing described units are all disposable with the piercing guide members such as 18 being formed of a polypropylene or polyester terephthalate plastic material. The additive containers such as 11, as well as the tubular neck portions such as 13, and the pierceable elements such as 16 can be conveniently composed of an ionomer or ethylene-vinyl acetate plastic material. The piercing member 23 as well as its correspondingly numbered counterparts are composed of a stainless steel or polycarbonate material. Obviously, other materials including plastics which are inert to I.V. liquids and are readily molded could be utilized in place of the indicated materials to form the various components.

Container 411 has been indicated as being of a rigid construction. If desired, it could be made of flexible material so as to be compressible. Finger grips 45 and 46 while indicated in the drawing as being two separate members could be a single disc to provide two contact points. In a preferred manner, needle guard 40, annular block 32 and wall means 37 could be insert molded in one operation around piercing member 23. In such instance, only block 32 would be secured to piercing member 23. Guard 40 and wall means 37 would be molded so as to permit piercing member 23 to slide thereon.

It will thus be seen that through the present invention there is now provided an additive transfer unit which is simplified in its construction utilizing a minimum number of parts. The units are readily activated in a basic one or two-step operation and are easily mounted over the additive port of an I.V. bag. The additive transfer devices are readily molded from standard molding equipment and do not require any special tooling or fabrication techniques.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

I claim:

1. An additive transfer device for storing and transferring of a medicament to a solution container having a pierceable closure comprising:

an additive container for storing the medicament to be transferred, said container having a tubular neck portion defining a flow path into said container;

a pierceable sealing element positioned in sealing engagement with the passageway in the additive container;

a piercing guide member having a projecting tubular portion adapted to be seated in said tubular neck portion;

a guide passageway extending through said guide member;

a piercing member having a channel therethrough for the flow of said medicament and a piercing point on both ends thereof, a portion of said piercing member in slidable contact with said guide passageway;

interlocking means operatively associated with said piercing guide member and said piercing member, said interlocking means defined by expandable finger portions providing an orifice and a compartment member and an annular projection receivable through said orifice and into said compartment member;

wall means extending from either said piercing guide member or said piercing member in a direction opposite said projecting tubular portion and coextensive with a portion of said piercing member except for the end portion defining said one point; and a needle guard member slidably received over said piercing member and surrounding said other piercing point with said annular projection including a contact member and carried by said piercing member and said expandable finger portions and compartment carried by said piercing guide, said needle guard member contacting said contact member opposite said orifice;

said interlocking means constructed and arranged in conjunction with said piercing member so that with said projecting tubular portion seated in said tubular neck portion one of said piercing points will be spaced from said pierceable sealing element, so that upon movement of said piercing member in said guide passageway and upon engagement of said interlocking means said one of said piercing points will puncture said pierceable sealing element and upon entry of the other piercing points through said closure of said solution container a pathway between the containers is provided and the medicament will flow into the solution container.

2. The additive transfer device as defined in claim 1 wherein said wall means is defined by two oppositely projecting arm members extending from said piercing guide member having portions disposed substantially parallel with said piercing member.

3. The additive transfer device in claim 2 further including a stabilizing member extending between arm members.

4. A piercing guide member adapted to provide fluid communication between a small volume additive container having a tubular neck portion with a pierceable sealing element and a solution container having a pierceable closure comprising:

a body member having a solid projection tubular portion adapted to be seated in said tubular neck portion;

a guide passageway extending through said body member;

a piercing member having a channel therethrough for the flow of said medicament and a piercing point on both ends thereof, a portion of said piercing member in slidable contact with said guide passageway;

interlocking means operatively associated with said body member and said piercing member, said interlocking means defined by expandable finger portions extending outwardly from said body member or said piercing member providing an orifice and a compartment member and an annular projection receivable through said orifice and into said compartment member;

wall means extending from either said piercing body member or said piercing member in a direction opposite said projecting tubular portion and coextensive with a portion of said piercing member except for the end portion defining said one point;

said interlocking means constructed and arranged in conjunction with said piercing member so that with said projecting tubular portion seated in said tubular neck portion one of said piercing points will be spaced from said pierceable sealing element and upon engagement of said interlocking means said piercing member will slide in said guide passageway and one of said piercing points will puncture said pierceable sealing element and upon entry of the other piercing points through said closure of said solution container a pathway between the containers is provided and the medicament will flow into the solution container.

* * * * *